United States Patent [19]

Corbett et al.

[11] Patent Number: 4,921,532

[45] Date of Patent: May 1, 1990

[54] IRONMAKING BY MEANS OF A SMELTING SHAFT FURNACE

[75] Inventors: Martin J. Corbett; Richard B. Smith, both of Guisborough, England

[73] Assignee: British Steel Corporation, London, England

[21] Appl. No.: 352,654

[22] Filed: May 12, 1989

Related U.S. Application Data

[63] Continuation of Ser. No. 939,128, filed as PCT GB86/00145 on Mar. 13, 1986, published as WO86/05520 on Sep. 25, 1986, abandoned.

[30] Foreign Application Priority Data

Mar. 14, 1985 [GB] United Kingdom ..... 8506655

[51] Int. Cl.[5] ..... C21B 5/00

[52] U.S. Cl. ..... 75/460; 266/182; 75/461

[58] Field of Search ..... 75/41, 42; 266/182

[56] References Cited

U.S. PATENT DOCUMENTS

| | | | |
|---|---|---|---|
| 1,518,854 | 12/1924 | Kirby . | |
| 3,547,624 | 12/1970 | Gray . | |
| 3,966,457 | 6/1976 | Limpach et al. | 75/42 |

FOREIGN PATENT DOCUMENTS

| | | | |
|---|---|---|---|
| 8102584 | 9/1981 | European Pat. Off. | 75/42 |
| 822089 | 11/1951 | Fed. Rep. of Germany . | |
| 1003466 | 3/1952 | France . | |
| 1010867 | 6/1952 | France . | |
| 1246936 | 10/1960 | France . | |
| 1259738 | 3/1961 | France . | |
| 1340858 | 9/1963 | France . | |
| 1547224 | 10/1968 | France . | |
| 39431 | 1/1961 | Luxembourg . | |
| 38966 | 1/1962 | Luxembourg . | |
| 675238 | 7/1952 | United Kingdom . | |
| 884493 | 12/1961 | United Kingdom . | |

*Primary Examiner*—Melvyn J. Andrews
*Attorney, Agent, or Firm*—Kinney & Lange

[57] ABSTRACT

A method of ironmaking by means of a smelting shaft furnace including the steps of supplying iron ore and coke to the top of the furnace; and injecting coal and oxygen into the smelting zone of the furnace to promote combustion, to control reaction temperature and provide heat for smelting, the quantities of coal and oxygen injection being within the range of 0.7 to 1.7 of stoichiometric conditions with respect to combustion to carbon monoxide and hydrogen.

15 Claims, 4 Drawing Sheets

IRONMAKING BY MEANS OF A SMELTING SHAFT FURNACE

This is a Continuation of application Ser. No. 939,128, filed as PCT GB86/00145 on Mar. 13, 1986, published as WO86/05520 on Sep. 25, 1986, now abandoned.

BACKGROUND OF THE INVENTION

1. Field of the Invention

This invention relates to ironmaking by means of a smelting shaft furnace, such shaft furnaces being typified by the modern blast furnace where a charge of coke, ore (usually including a proportion of sinter and perhaps pelletised material), and various additives is inserted in the top of the furnace, and the necessary combustion and smelting if affected in the furnace by means of hot air blasts injected into the furnace via tuyeres from the Bustle pipe in the Bosh zone of the furnace. The product of such furnaces is iron which is tapped from the hearth adjacent the base of the furnace.

2. Description of the prior art

It has previously been proposed, with blast furnaces, to introduce into the blast at the tuyeres, fuel oil or other hydrocarbon fuel to enrich and augment the thermal input and hence reduce the coke requirement of the furnace. Again it has been proposed to use coal, in granular form or powder form, or in the form of a powder or slurry in water as such fuel. It has similarly been proposed to introduce modest levels of oxygen enrichment of the hot blast to enhance the smelting capability of the furnace. All of these proposals, however, are only intended to augment and improve the standard operation of the blast furnace. The blast furnace operation with such augmentation continues to be operated in normal manner, albeit hopefully with greater efficiency in production and/or economics.

SUMMARY OF THE INVENTION

It is an object of the present invention to provide a shaft furnace arrangement capable of improved operation with enhanced consumption of coal and oxygen.

In accordance with the present invention, there is provided a method of ironmaking by means of a smelting shaft furnace including the steps of supplying iron ore and coke to the top of the furnace, and injecting coal and oxygen into the smelting zone of the furnace to promote combustion, to control reaction temperature and provide heat for smelting, the quantities of the coal and oxygen injections being within the range of 0.7 to 1.7 of stochiometric conditions with respect to combustion to carbon monoxide and hydrogen.

The carbon monoxide and hydrogen so generated act as part of the reductant for the iron ore in the shaft.

In order to ensure satisfactory reaction of the injected coal and oxygen they may generally be injected at approximately the same time.

The proportions of the coal and oxygen are preferably within the range of 0.9 to 1.3 of stochiometric conditions.

The oxygen may be injected undiluted, or admixed with an air blast, or injected in association with a hot air blast.

The coal may be of any composition such as an anthracite, a coking coal or a high volatile coal and may of of suitable granular size such as −3 mm. The preferred coals, from economic considerations, are usually general purpose industrial coals.

The oxygen and coal may be introduced by means of a single entry element or assembly such as a lance or burner or the coal may be separately entered into the furnace from the oxygen, for example, by separate lances or, at modest levels of oxygen addition, the oxygen may be admixed with an air blast as mentioned above. The coal may include moisture, and can be in the form of a slurry pumped into the furnace preferably adjacent an oxygen injection lance.

With a blast furnace, injection via one or more lances of the coal and oxygen may be through the blast tuyeres into the smelting zone. However, at large injection levels of coal and oxygen, the usual blast furnace tuyeres can be replaced by oxygen and coal burner lances disposed around the furnace.

Because of the controlled heat liberation in the reaction zone which can be produced by means of the invention, and because of the presence of oxygen, additives can be introduced into the furnace via lances to assist in control of the process chemistry, e.g. fine iron ore for low silicon iron production or additives to aid desulphurisation. Higher injection levels of fine ore are also possible and allow reduction of the ore charged into the top of the furnace.

It has been found that by means of the invention there is a much smaller need for coke in the top charge to the furnace with the iron ore, the limit of the replacement of the coke in the furnace by the oxygen and coal injection being determined by the requirement for coke within the furnace to provide support and gas permeability during the high temperature reactions taking place which result in softening and melting of the burden.

In addition, the use of oxygen injection in at least partial replacement of the hot air blast in a blast furnace ensures that increases in productivity of the furnace, and in the calorific value of off-gas result.

The invention has the added advantage of enabling the continuing use of existing blast furnace equipment at maximised efficiency.

Finally, it is to be noted that in addition to the calorific value of the off-gas being increased, there is also more useful off-gas produced due to the presence of a greater quantity of volatiles of a hydrocarbon nature in coal than in the coke utilised in the burden.

The invention includes within its scope a smelting shaft furnace for carrying out the method of ironmaking hereinabove described.

In order that the invention may be more readily understood, two embodiments thereof will now be described by way of example with reference to the accompanying drawings in which:

DETAILED DESCRIPTION OF THE PREFERRED EMBODIMENTS

Figure 1:
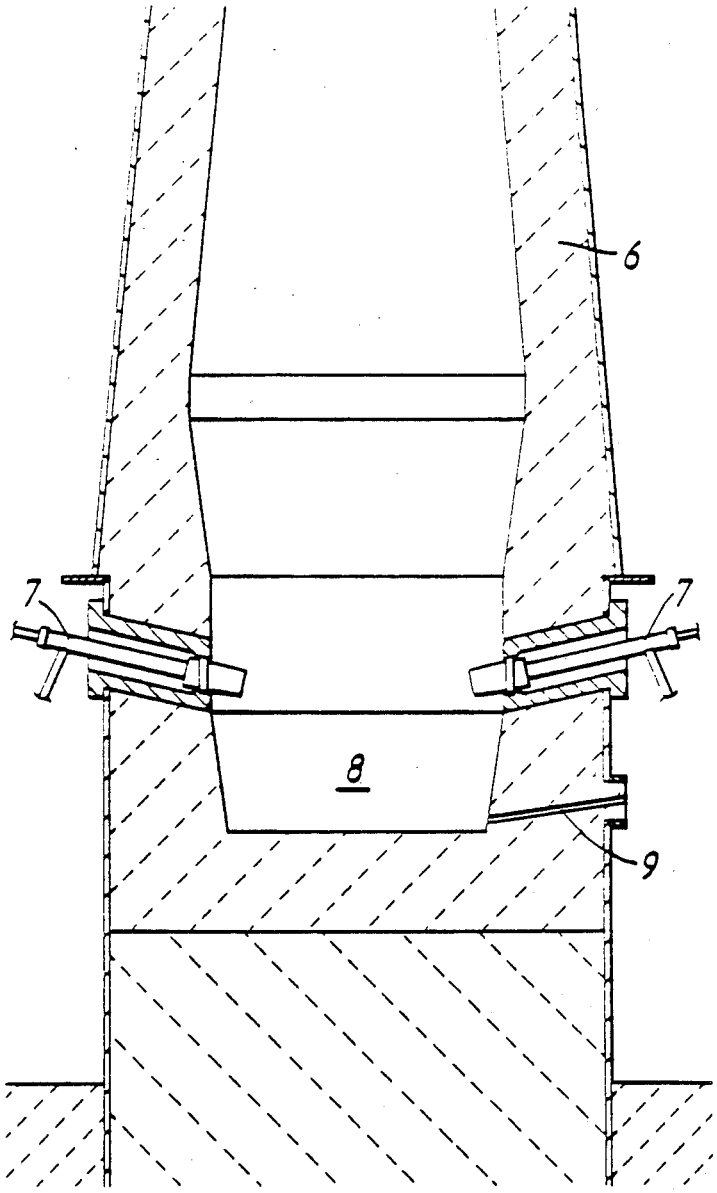
FIG. 1 is a cross-sectional elevation of a straight shaft furnace incorporating the operational features of the invention without any blast injection ring.

FIG. 1 illustrates an application of the invention to a straight shaft furnace. In this figure, the usual arrangement of a blast furnace has been dispensed with and an overhead shaft furnace 6 to which a burden of ore and a limited quantity of coke can be added. As can be seen a burner arrangement 7 (shown in detail in FIG. 2) is utilised to inject a combination of oxygen and coal which burns in a smelting zone above the hearth 8 of the furnace and smelts the ore to produce iron subsequently tapped at 9. In this embodiment hot air blast has been completely eliminated.

Figure 2:
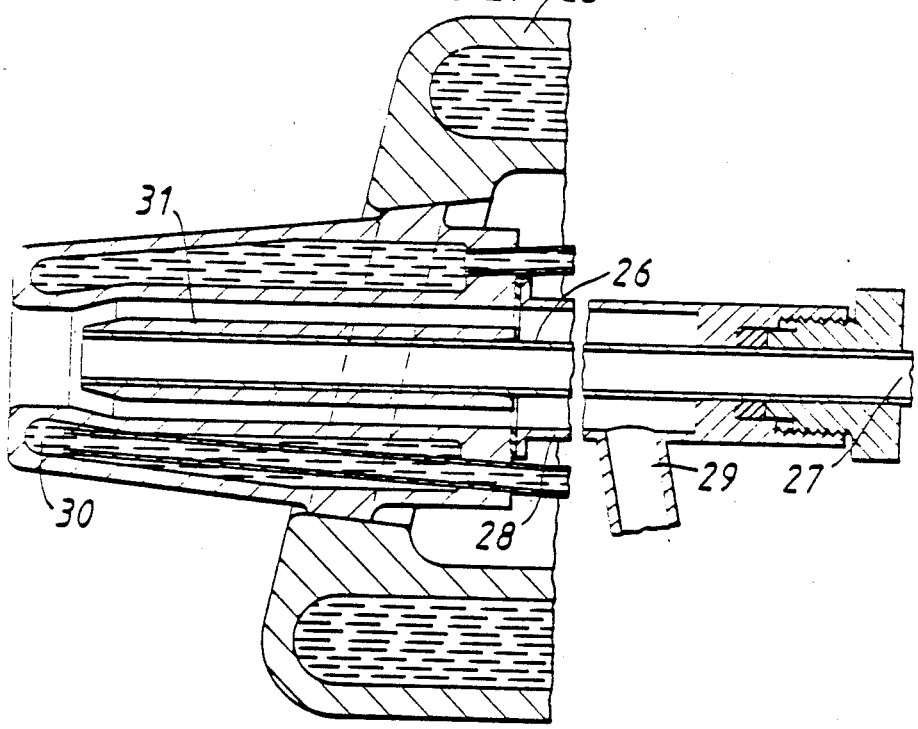
FIG. 2 is a sectional elevation of the oxy-coal burner lance arrangement of FIG. 1.

As can be seen in FIG. 2 the burner arrangement has a water cooled jacket 25, and double, concentric, pipe arrangement. The inner pipe 26 carries coal from supply conduit 27, whilst the outer pipe 28 carries oxygen from supply conduit 29. The noses of the pipes 26 and 28 project into the furnace beyond the jacket 25 so that mixing, and combustion, of the coal and oxygen is within the furnace. The tip of pipe 28 is provided with water cooling at 30 for protection.

Other designs can be envisaged including the introduction of coal such as to enhance the cooling of the oxygen carrier and surrounding assembly. In such an arrangement coal would be introduced around the periphery of the oxygen stream in the form of an annulus or a number of discrete jets.

In a typical operational example with a coal/air injection rate through coal lances of 550 kg per thm (equivalent to a dry coal injection rate of 486 kg per thm) and an oxygen injection rate of 0.477 tonnes per thm, a reduction of coke in the burden from 490 kg per thm to 109 kg per thm was possible with satisfactory smelting temperatures and performance. In this example, the quantities of coal and oxygen injections are 0.98 of stochiometric conditions with respect to combustion to carbon monoxide and hydrogen.

Figure 3:
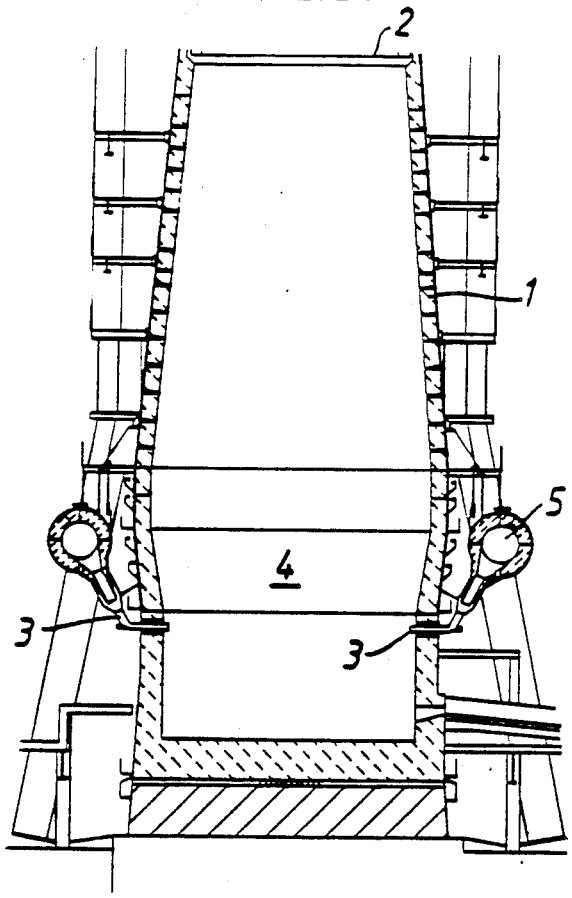
FIG. 3 is a cross-sectional of a blast furnace incorporating the operational features of the present invention.

Referring now to FIG. 3 it will be seen that there is illustrated a blast furnace 1 of usual construction which, in accordance with normal operating procedure, is arranged to have supplied to the top thereof a burden 2 comprising a mixture of ore (including a proportion of sinter and iron ore pellets) and coke and other relatively minor additives. The burden moves downwardly through the furnace and is met at the smelting zone 4, with a hot blast introduced from tuyeres 3 fed from Bustle pipe 5, such hot blast normally comprising hot air. In addition to the hot blast entering the furnace through the tuyeres 3, the tuyeres have been adapted in accordance with the arrangements of FIGS. 4, 5 or 6 for the injection of oxygen and coal. In one practical embodiment an injection of 30 kg per minute of coal through each tuyere of the furnace and oxygen up to $15m^3$ per minute was injected (the latter making up the oxygen content in the blast to each tuyere to 33%). With such injection the requirement for coke in the burden was significantly reduced and the smelting efficiency increased by the increased amount of heat introduced by the combustion of the coal and the oxygen.

In one typical example of the invention with a coal/air injection rate through coal lances of 300 kg per thm (equivalent to a dry coal injection rate of 265 kg per thm) and an oxygen injection rate of 0.276 tonnes per thm, a reduction of coke in the burden from 490 kg per thm to 283 kg per thm and a blast volume reduction of 1104 $nm^3$ per therm to 693 $nm^3$ per thm is possible with satisfactory smelting temperatures and performance. In this example, the quantities of coal and oxygen injections are 0.99 of stochiometric conditions with respect to combustion to carbon monoxide and hydrogen.

This example utilised a blast furnace operating with a burden of 75% sinter and 25% pellets.

Figure 4:
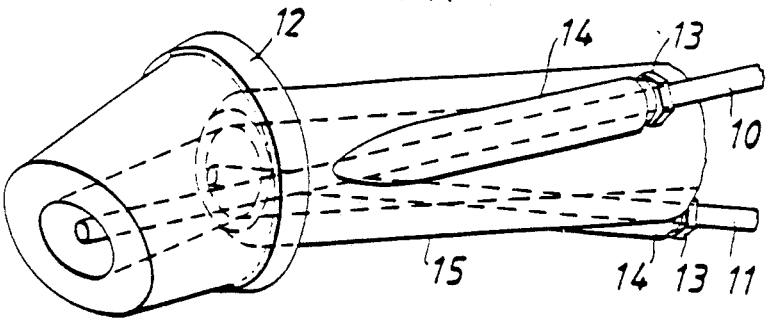
FIG. 4 is an isometric diagram, of a blast furnace tuyere to which has been added oxygen and coal lances for operation of the invention.
Figure 5:
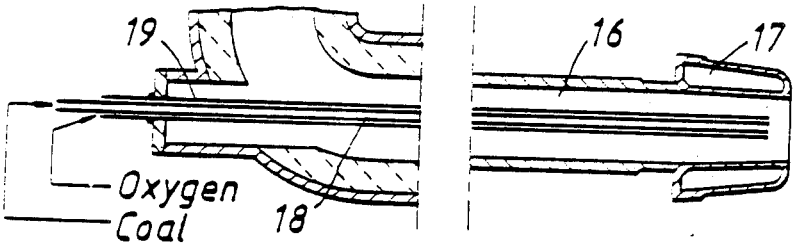
FIG. 5 is a schematic sectional elevation of an alternative arrangement of tuyere from that shown in FIG. 4.
Figure 6:
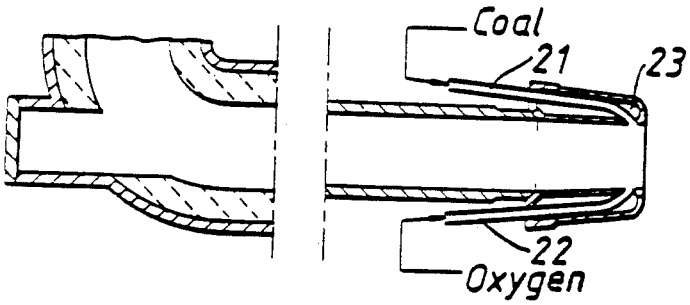
FIG. 6 is a schematic sectional elevation of part of yet another alternative arrangement of tuyere from that illustrated in FIG. 4.

FIGS. 4 to 6 illustrate alternative arrangements of oxygen and coal injection. That shown in FIG. 4 has separate lances 10, 11 projecting via glands 13 and shrouds 14 into a blast furnace pipe 15 and tuyere 12 for the coal and the oxygen, the coal usually being entrained in air in lance 10. Such an arrangement is simple and effective in its installation and operation in a blast furnace tuyere.

An alternative arrangement is illustrated in FIG. 5 where a double, concentric, lance formed of oxidation resistant material, such as Inconel, is mounted in blast pipe 16 and tuyere 17 of a blast furnace is illustrated. In this instance the oxygen pipe is the outer pipe 19 and is concentric to the inner pipe 18 which carries the coal. Such an arrangement again is simple to implement and can easily be installed and from the juxtaposition of the outlets from the coal and oxygen pipes leads to efficient combustion of the coal and oxygen.

FIG. 6 shows yet a further arrangement in which coal and oxygen are injected separately through ports 21, 22 cast into the tuyere 23. The coal and oxygen can enter the furnace each through a single port or through a plurality of ports around the periphery of the tuyere.

We claim:

1. A method of ironmaking by means of a smelting shaft furnace including the steps of supplying iron ore and coke to the top of the furnace; and injecting coal and oxygen into the smelting zone of the furnace to promote combustion, to control reaction temperature and provide heat for smelting, the quantities of coal and oxygen injections being within the range of 0.7 to 1.7 of stochiometric conditions with respect to combustion to carbon monoxide and hydrogen.

2. A method as claimed in claim 1 wherein the proportions of the coal and oxygen are within the range of 0.9 to 1.3 of stochiometric conditions.

3. A method as claimed in claim 1 wherein the oxygen is injected undiluted.

4. A method as claimed in claim 1 wherein the oxygen is injected admixed in an air blast.

5. A method as claimed in claim 1 wherein the coal is a general purpose industrial coal.

6. A method as claimed in claim 1 wherein the coal is of granular size less than 3 mm.

7. A method as claimed in claim 1 wherein the oxygen and coal are introduced via at least one combined entry element or assembly.

8. A method as claimed in claim 7 wherein the oxygen and coal are introduced via at least one burner lance.

9. A method as claimed in claim 1 wherein the oxygen and coal are introduced by separate entry elements or assemblies.

10. A method as claimed in claim 1 wherein the coal is in the form a coal/water slurry.

11. A method as claimed in claim 1 wherein the oxygen is passed to its entry assembly through a carrier element and the coal is introduced in such a manner as to enhance cooling of the oxygen carrier element and entry assembly.

12. A method as claimed in claim 1 for use with a blast furnace, wherein the coal and oxygen is injected by means of lances via at least some of the blast tuyeres.

13. A method as claimed in claim 1 for use with a blast furnace, wherein the coal and oxygen is injected by means of oxygen and coal burners disposed around the furnace in place at least some of the usual blast furnace tuyeres.

14. A method as claimed in claim 1 wherein additives are injected into the furnace in association with the coal and oxygen injections for control of the process chemistry.

15. A method as claimed in claim 1 wherein a proportion of the total ore charged to the furnace is injected as fine ore in association with the coal and oxygen injections.

* * * * *